United States Patent [19]

Takenaka et al.

[11] 4,322,655

[45] Mar. 30, 1982

[54] BEAM INDEX COLOR CATHODE RAY TUBE

[75] Inventors: Shigeo Takenaka, Fukaya; Eizaburo Hamano, Kumagaya, both of Japan

[73] Assignee: Tokyo Shibaura Denki Kabushiki Kaisha, Kawasaki, Japan

[21] Appl. No.: 222,325

[22] Filed: Jan. 5, 1981

Related U.S. Application Data

[63] Continuation of Ser. No. 973,125, Dec. 26, 1978, abandoned.

[30] Foreign Application Priority Data

Dec. 28, 1977 [JP] Japan ..... 52-157284

[51] Int. Cl.[3] ..... H01J 29/56; H01J 29/34; H01J 29/46

[52] U.S. Cl. ..... 313/471; 313/449

[58] Field of Search ..... 313/414, 449, 471, 460

[56] References Cited

U.S. PATENT DOCUMENTS

| | | | |
|---|---|---|---|
| 2,859,378 | 11/1958 | Gundert et al. | 313/414 X |
| 2,884,559 | 4/1959 | Cooper et al. | 313/449 X |
| 3,866,081 | 2/1975 | Hasker et al. | 313/449 |
| 3,919,583 | 11/1975 | Hasker et al. | 313/414 X |
| 3,952,224 | 4/1976 | Evans | 313/449 X |
| 4,142,128 | 2/1979 | Odenthal | 313/460 X |
| 4,143,293 | 3/1979 | Hosokoshi et al. | 313/414 X |

*Primary Examiner*—Robert Segal

*Attorney, Agent, or Firm*—Oblon, Fisher, Spivak, McClelland & Maier

[57] ABSTRACT

A beam index color cathode ray tube is provided with a screen arranged on the inner surface of a face plate portion and an electron gun arranged in a neck portion thereof. This screen comprises phosphor stripes and index stripes. The electron gun comprises at least a cathode and two electrodes forming a focusing lens. The focusing lens of the electron gun is formed between at least two electrodes provided with transversely elongate openings having their direction of elongation in the width direction of the phosphor stripes or index stripes.

4 Claims, 8 Drawing Figures

BEAM INDEX COLOR CATHODE RAY TUBE

This is a continuation of application Ser. No. 973,125, Dec. 26, 1978, abandoned.

BACKGROUND OF THE INVENTION

1. Field of the Invention

This invention relates to a beam index color cathode ray tube, and, more particular, to a beam index color cathode ray tube provided with an improved electron gun.

2. Description of the Prior Art

In general, the screen which is provided on the inner surface of the face plate of an index color cathode ray tube consists of a fluorescent screen in which phosphor stripes and light absorbing stripes are alternately arranged, an aluminium layer which is adhered over this fluorescent screen, and index stripes which are disposed practically parallel with the phosphor stripes on this aluminium layer.

Since such an index color cathode ray tube does not have the color selecting electrode of the shadow mask color cathode ray tube, the width, in the direction of the phosphor stripes array, of the electron beam which scans the fluorescent screen must be less than the sum of the width of a single phosphor stripe and the width of the light absorbing stripe. However, in practice, the width of this electron beam must be less than $\frac{1}{3}$ of the width of a group of phosphor stripes of three colors (i.e. the phosphor trio pitch). For example, since the phosphor trio pitch of a 20-inch cathode ray tube is about 0.9 mm, the width of this electron beam must be less than 0.3 mm.

So as to satisfy the above described dimensional relation between the width of the phosphor stripe and that of electron beam, an electron gun, which comprises a triode portion having a vertically elongated opening and a main lens portion having a circular opening, is employed for this type of color cathode ray tube. The triode portion comprises a cathode, a first grid electrode positioned close to the cathode and a second grid electrode. The main lens portion comprises a third and fourth grid electrode which works as a focusing lens. But, even if the triode portion has a vertically elongated opening, it is not enough to obtain such a narrow electron beam due to a limitation of diameter of the circular opening of the main lens, because in an ordinary electron gun, the diameter of the circular opening of the main lens portion is not so large that spherical aberration of the focusing lense can be neglected due to the space factors in the neck portion, such as, limitation of the inner diameter of the neck portion, size of the supporter fixing the electrodes constructing the electron gun and so on. So, the electron beam can not be correctly focused at the phosphor screen because of the spherical aberration of the focusing lens, and a color cathode ray tube having good color reproduction is not obtained.

SUMMARY OF THE INVENTION

The object of this invention is to provide an index color cathode ray tube having good color reproduction.

A further object of this invention is to provide a color cathode ray tube provided with an electron gun which emits a vertically elongate electron beam of narrow width.

According to this invention there is obtained a beam index color cathode ray tube which is provided with a screen comprising at least phosphor stripes and index stripes and disposed on the inner surface of the face plate, and an electron gun which is arranged inside a neck portion opposite to the screen, the focusing lens of this electron gun being formed between at least two electrodes having transversely elongate openings which have a direction of elongation which is parallel to the width direction of the phosphor stripes or index stripes.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

Preferred embodiments of this invention are explained below with reference to the drawings.

Figure 1:
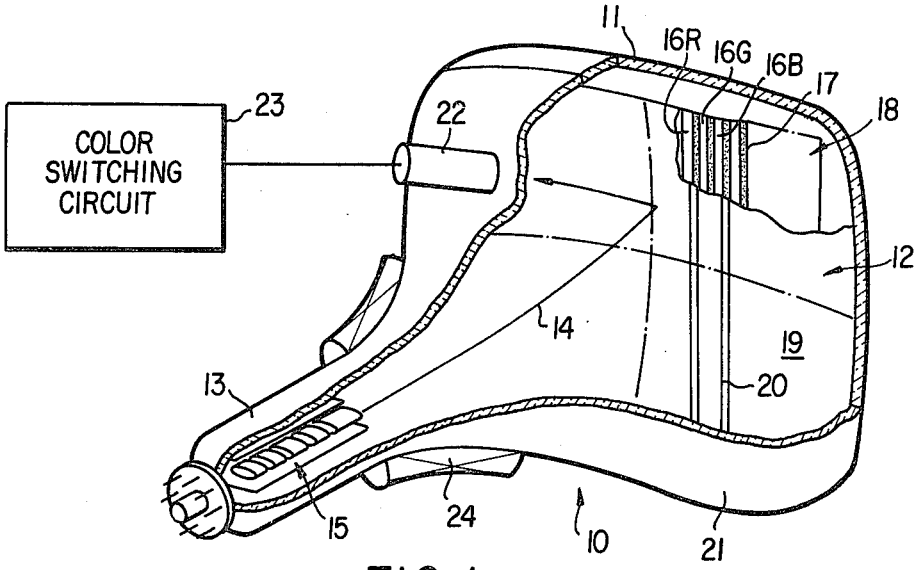
FIG. 1 is a perspective view of a beam index color cathode ray tube given in explanation of an embodiment of this invention.

Referring to FIG. 1, a beam index color cathode ray tube (10) is constructed of a screen (12) arranged on the inner surface of a face plate portion (11) and an electron gun (15) which is arranged inside a neck portion (13) and which emits an electron beam (14) which has a vertically elongate oval cross-sectional shape and which scans over the screen (12). This screen (12) is composed of a fluorescent screen (18) comprising phosphor stripes (16R, 16G, 16B) and light absorbing stripes (17) arranged alternately on the inner surface of the face plate portion (11), an aluminium layer (19) adhered onto this fluorescent screen (18), and index stripes (20) which are disposed on this aluminum layer (19) practically parallel with the phosphor stripes (16). These index stripes (20) are arranged with a different pitch to that of the phosphor stripes (16).

This beam index color cathode ray tube (10) is further provided with a photo-electric tube (22) which is mounted on the conical portion (21) connecting the face plate portion (11) with the neck portion (13), and which converts the light emitted from the index stripes (20) into electrical signals. The electrical signals from this photo-electric tube (22) are applied to the color switching circuit (23). The switching circuit (23) selects the color signal to be applied to the electron gun (15) in accordance with the signals from the photo-electric tube (22).

The beam index color cathode ray tube (10) is further fitted with a deflection yoke (24) which deflects the electron beam (14).

Figure 2:
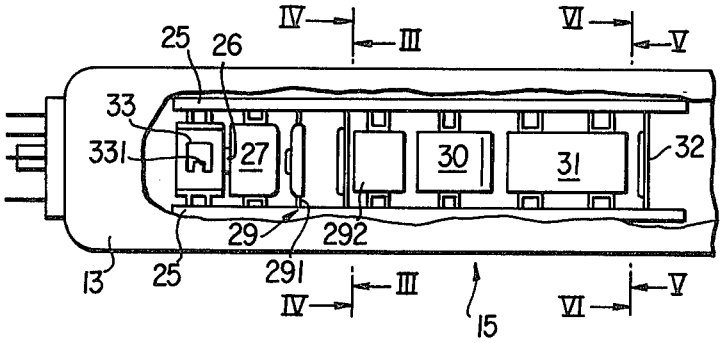
FIG. 2 is a partial plan view of FIG. 1.

The details of the electron gun (15) of this beam index color cathode ray tube (10) are shown in FIG. 2. The electron gun (15), from the end of the neck portion (13) and towards the screen (12), is constituted of a cathode (26) which emits thermal electrons, a $G_1$ electrode (27), a $G_2$ electrode (28), a $G_3$ electrode (29), a $G_4$ electrode (30), a $G_5$ electrode (31), and a limiting electrode (32), these being supported by a pair of glass beads (25). A cathode (26) is of cylindrical shape and has a heater (not shown) arranged within it, and is supported by welding to projected portions (331) of a pair of support parts (33) which are embedded in the glass beads (25). The $G_1$ electrode (27) has the shape of a cylinder provided with a bottom and has a small oval vertically elongate hole at the bottom end and arranged adjacent to the electron emitting surface of said cathode. The $G_2$ electrode (28) has a narrow width and is cup-shaped. It has a hole disposed adjacent to the small hole of the $G_1$ electrode (27). The $G_3$ electrode (29) has a similar shape to the $G_2$ electrode (28). The cathode (26), the $G_1$ electrode (27) and the $G_2$ electrode (28) constitute a triode portion.

Figure 3:
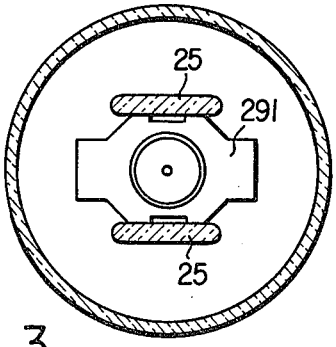
FIG. 3 is a cross-sectional view, to a larger scale, along the line III—III of FIG. 2.
Figure 4:
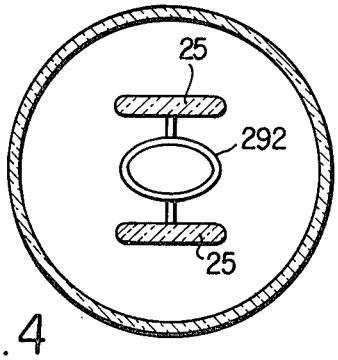
FIG. 4 is a cross-sectional view, to a larger scale, along the line IV—IV of FIG. 2.
Figure 5:
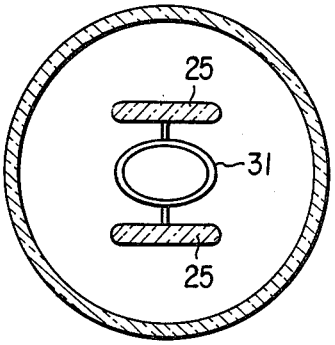
FIG. 5 is a cross-sectional view, to a larger scale, along the line V—V of FIG. 2.
Figure 6:
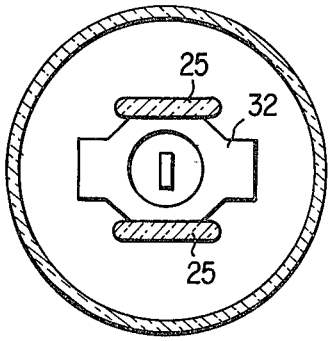
FIG. 6 is a cross-sectional view, to a larger scale, along the line VI—VI of FIG. 2.

For the $G_3$ electrode (29), there are provided sectional views along lines III—III and IV—IV of FIG. 2. As shown in FIGS. 3 and 4 it comprises a first electrode (291) which is plate-shaped and has a circular hole arranged on the cathode side, and a second electrode (292) which is shaped as a transversely elongate oval cylinder having its direction of elongation in the width direction of the phosphor stripes of the screen. The $G_4$ electrode (30) and the $G_5$ electrode (31) (as shown in FIG. 5) are respectively constructed of cylindrical electrodes which have a transversely elongate oval cross-section similar to the second electrode (292) (of the $G_3$ electrode (29). On the screen side of the $G_5$ electrode (31) there is arranged a limiting electrode (32) which consists of a plate-shaped electrode having a vertically elongate rectangular hole, as shown in FIG. 6. The $G_3$ electrode (29), $G_4$ electrode (30) and $G_5$ electrode (31) constitute a main lens portion and a focusing lens is formed among them.

In such an electron gun, the focusing lens formed between the $G_3$ electrode, $G_4$ electrode and $G_5$ electrode has an opening of transversely elongate shape having its direction of elongation parallel to the arrangement direction of the phosphor stripes. For this reason the spherical aberration of the focusing lens in the width direction of the phosphor stripes of the electron beam, necessary in a beam index color cathode ray tube, becomes small. Thus an electron beam of a smaller width, in the width direction of the phosphor stripes, is obtained than is obtained with a focusing lens formed between electrodes having the circular openings.

Therefor, an electron gun for providing an electron beam having an extremely narrow width in the horizontal direction can be obtained. The openings of the second electrode (292) of the $G_3$ electrode (29), the $G_4$ electrode (30), and the $G_5$ electrode (31) may for example be ellipses of dimensions about 16 mm along their major axes and about 12 mm along their minor axes. In this case, the ratio of the lengths along the major axis and along the minor axis of the opening of the electrodes which form the focusing lens, which is the criterion of the spherical aberration is $16/12 \sim 1.3$, so the spherical aberration is very small. This value is for the case of an electron gun to be arranged in a neck part having an internal diameter of 29 mm. The opening may be increased or diminished so that the ratio of the minor axis of the opening and the major axis approaches the above-mentioned value in comparison with increase or decrease of the internal diameter of the neck part.

A beam index color cathode ray tube provided with an electron gun as above gives and electron beam width of less than $\frac{1}{3}$ of the phosphor trio pitch in the direction parallel to the width direction of the phosphor stripes and can therefore reproduce images with good color reproduction.

Figure 7:
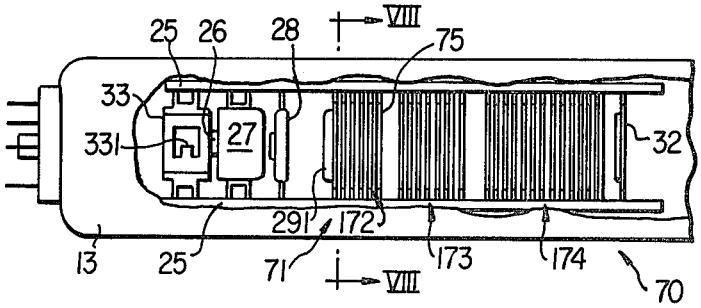
FIG. 7 is a plan view of the electron gun part of a beam index color cathode ray tube given in explanation of another embodiment of this invention.
Figure 8:
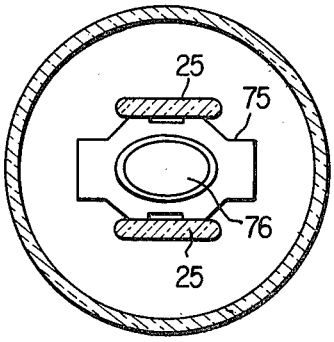
FIG. 8 is a cross-sectional view along the line VIII—VIII of FIG. 7.

FIG. 7 is given in explanation of another embodiment of this invention. Similar parts to those of FIG. 2 have the same reference numerals and an explanation of them is therefore omitted. As shown in FIG. 8, the second electrode (172) of the $G_3$ electrode (71) of this electron gun (70) comprises a plurality of plate-shaped electrodes (75) having, in their middle parts, elliptical openings (76) which have their direction of elongation parallel to the width direction of the phosphor stripes. The first group of electrodes (172) composed of these plate-shaped electrodes (75) has the same operation as the second electrode (292) shown in FIG. 2. In this electron gun (70), the second group of electrodes (173) and third group of electrode (174) are respectively formed by an assembly of the plate-shaped electrodes (75).

An electron gun having such a construction has the same operation and result as the electron gun explained with reference to FIG. 2 so far as the width of the electron beam is concerned.

Further, in the case of this electron gun, as the electrodes which compose the main convergence electrodes are constructed of plate-shaped electrodes, there is the constructional advantage that the elliptical or other shaped transversely elongate openings can be manufactured comparatively easily.

Such a narrow electron beam for a beam index color cathode ray tube can be obtained by employing the electron gun which has a triode portion having a transversely elongate shape opening the same as the main lens portion.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A beam index color cathode ray tube comprising:

an envelope which includes a face plate portion, a neck portion, and a conical portion provided between the face plate portion and the neck portion;

a screen provided on the inner surface of the face plate portion, said screen including an array of light-emitting phosphor stripes each of which is arranged in a first direction and extends in a second direction intersecting said first direction at a right angle, and a plurality of radiation-emissive indexing stripes arranged and extending parallel to the phosphor stripes;

an electron gun which includes a triode portion comprising at least a cathode and a first grid electrode, and a main lens portion consisting of second, third and fourth grid electrodes which form a main focus lens therebetween;

said first grid electrode, which is provided near the cathode electrode, has an elongated opening having major and minor axes which are parallel to said second direction and parallel to said first direction respectively, so that the cross-sectional shape of the electron beam emitted from said triode portion is formed to be an elongated shape having major and minor axes which are parallel to said second direction and parallel to said first direction respectively;

said second, third and fourth electrodes, each of which has an elongated opening having major and minor axes which are parallel to said first direction and parallel to said second direction respectively, form the main lens without spherical aberration in said first direction so that focusing of the electron beam in said first direction is stronger than in said second direction; and wherein the width of the electron beam on the screen is less than the width of each phosphor stripe through the entire screen.

2. The beam index color cathode ray tube according to claim 1 wherein each of second, third and fourth electrodes includes a plurality of plate-shaped electrodes which have openings of transversely elongated shape whose direction of elongation is parallel to said first direction.

3. The beam index color cathode ray tube according to claim 1 wherein the internal diameter of said neck portion is 29 mm and the transversely elongate shape openings in said at least two electrodes having major axes dimensions of 16 mm and minor axes dimensions of 12 mm.

4. The beam index color cathode ray tube according to claim 1 or 2 including:

a pair of supporting members for fixing the electrodes extending parallel to the arrangement of electrodes and disposed on the upper and lower sides of the major axis of the elongated opening of the main focusing portion.

* * * * *